United States Patent [19]

Alliot

[11] 4,368,693

[45] Jan. 18, 1983

[54] DISTRIBUTOR FOR THE ADMISSION OF A FLUID TO BE VAPORIZED INTO A STEAM GENERATOR

[75] Inventor: Patrick Alliot, Paris, France

[73] Assignee: Framatome, Courbevoie, France

[21] Appl. No.: 281,743

[22] Filed: Jul. 9, 1981

[30] Foreign Application Priority Data

Jul. 31, 1980 [FR] France ..... 80 16880

[51] Int. Cl.[3] ..... F22B 1/06

[52] U.S. Cl. ..... 122/491; 239/567; 122/406 B

[58] Field of Search ..... 122/491, 489, 406 B, 122/451; 239/567, 523

[56] References Cited

U.S. PATENT DOCUMENTS 2,864,652 12/1958 O'Brien et al. ..... 239/523
3,185,397 5/1965 Nelson ..... 239/567
3,526,109 9/1970 Kirche ..... 239/567
3,580,226 5/1971 Blackburn, Jr. ..... 110/170
3,854,453 12/1974 Mayer et al. ..... 122/491
3,894,517 7/1975 Meier ..... 122/491

FOREIGN PATENT DOCUMENTS 2333200 6/1977 France .

*Primary Examiner*—Henry C. Yuen
*Attorney, Agent, or Firm*—Pollock, Vande Sande & Priddy

[57] ABSTRACT

A distributor for supply of fluid to be vaporized, for example water, to a steam generator is formed by means of plates shaped and assembled by boiler-work operations. The bottom is constituted by a metal sheet bent into a U-shape to which are welded a plate pierced with orifices and a V-shaped plate of which an arm is prolonged by a gutter extending beyond the orifices and serving to guide the flow of water. This type of distributor is particularly useful in steam generators of nuclear power plants.

3 Claims, 3 Drawing Figures

DISTRIBUTOR FOR THE ADMISSION OF A FLUID TO BE VAPORIZED INTO A STEAM GENERATOR

FIELD OF THE INVENTION

The present invention relates to steam generators including a system for supplying fluid to be vaporized, for example water, having an annular ring-shaped distributor, positioned at the top part of these generators.

BACKGROUND OF THE INVENTION

Generators of this type are used particularly in nuclear power stations, where the vaporization of water constituting the secondary fluid is assured by contact with a bundle of tubes in which flows a primary fluid, heated by the nuclear reactor. To avoid "water-hammer" effects in the supply pipes wherein the water circulates, it is essential that the distributor should remain constantly full of water in order not to enclose a vapor pocket during its filling. During the normal operation of the steam generator, the water distributor is covered by the mass of water already present in the generator and no "water-hammer" effect is to be feared. However, during certain so-called "transient" phases of operation, it may happen that the distributor is no longer covered, and there is then a risk of it being completely emptied so that, if it is resupplied with cold water, a water hammer can occur in the pipes.

To avoid this drawback, a distributor structure has been proposed preventing the confinement of a vapor pocket. In such a construction, as described, e.g., in the French Patent published under 2,333,200, the distributor is constituted by an angular duct furnished at its top portion with curved tubes through which the feed water flows.

However, such a structure is relatively costly, due to the expense of fabricating curved tubes and of machining the distributor duct.

It is an object of the present invention to provide an improved distributor of very simple construction which can be formed from standard elements and has a relatively low manufacturing cost.

SUMMARY OF THE INVENTION

According to the invention there is provided a distributor formed by a duct and flow means for the fluid to be vaporized, such as water, causing the inside of the duct to communicate with the surrounding medium and arranged over the length of the duct and at the top part of the latter, said duct and flow means being formed by means of metal plates shaped and assembled rigidly to one another by simple operations of boiler work and welding, namely a bent wall forming the base of the duct, two lateral walls and a top wall closing the duct, one of the lateral walls being pierced by flow orifices situated in the vicinity of the top wall. Advantageously, the top wall has, beyond the lateral wall pierced with orifices, an outer prolongation serving for the guidance downwards of the fluid flowing through the orifices.

BRIEF DESCRIPTION OF THE DRAWINGS

There will now be described, purely by way of illustrative and non-limiting example, a preferred embodiment of the invention, with reference to the accompanying drawings in which.

DETAILED DESCRIPTION OF A PREFERRED EMBODIMENT

Figure 1:
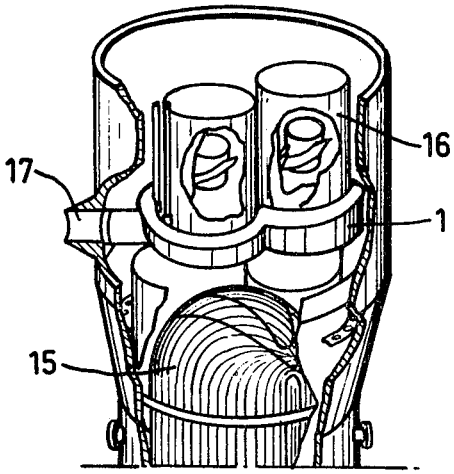
FIG. 1 is a perspective view showing the distributor housed in a steam generator.

FIG. 1 shows diagrammatically, by way of example, the implantation of the distributor of the invention inside a steam generator of a nuclear power generating station. The distributor 1 is situated at the upper part of an annular chamber surrounding a central chamber of which the bottom part is occupied by a bundle of tubes 15 in which primary fluid flows, this bundle being dominated by steam drying systems 16. In normal operation, the outer annular chamber is filled with water and the distributor 1 is covered by water. The distributor 1 has the shape of an annular ring and is connected to a water inlet pipe 17. It amounts here to a conventional arrangement which will therefore not be described in detail.

Figure 2:
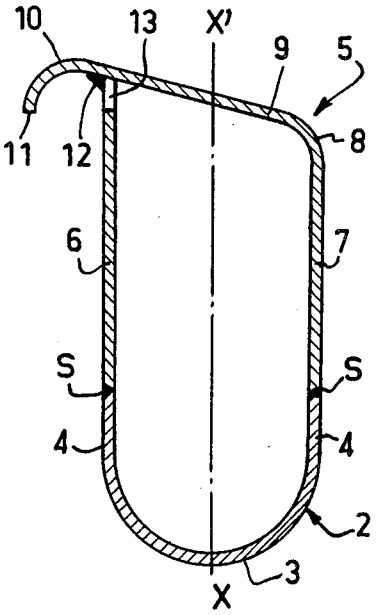
FIG. 2 is a cross-section of the distributor according to the invention.
Figure 3:
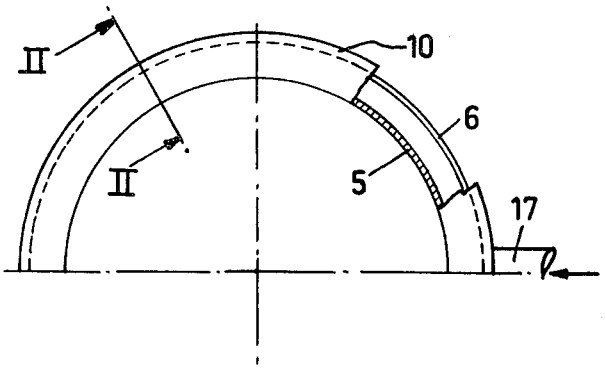
FIG. 3 is a half plan view of the distributor of the invention, partly cut away, showing at II—II the section line of FIG. 2.

The structure of the distributor which specifically forms the subject of the invention will be described with reference to FIGS. 2 and 3. The whole of the distributor, i.e., both the annular duct and the means for the flow of water to the outside, is constructed by means of metal plates shaped and assembled by simple boiler work and welding operations.

In the example illustrated, a section of the distributor 1 is formed by three plates. The bottom 2 of the duct is constituted by a plate shaped in a U to present a bent middle portion 3 and two parallel lateral arms 4 symmetrical with respect to the axis XX' of the duct.

A second plate, denoted generally by 5, is folded into a V, one arm 7 of the V being abutted to the arm 4 of the bottom and welded at S, while the second arm 9 of the V (beyond the elbow 8) constitutes the top of the duct.

A third plate 6, flat, is abutted and welded at S to the arm 4 of the bottom 2. In the example illustrated, the portions 6 and 7 form the lateral walls of the duct and are substantially parallel to the axis XX'. Advantageously, the wall 6 is longer than the wall 7 and its free end serves as a support for the arm 9, so that the top wall is inclined downwards from the wall 6. The duct is closed by a weld bead 12 between the walls 6 and 9.

The top wall 9 extends outwardly beyond the wall 6, the prolongation 10 is curved downwards and forms a gutter designed to assure guidance of the water emerging from the duct, the free end 11 of the gutter 10 being separated from the wall 6. As can be seen in FIG. 2, the upper edge of the wall 6 is pierced from place to place by orifices 13 causing the inside of the duct to communicate with the surrounding medium, these orifices permitting the flow of water to the outside.

In this way, by reason of the emplacement of the orifices 13, the retention of vapor pockets is avoided even if the level of the water into which the distributor dips should drop below the plane passing through the lower edge of the orifices 13.

Advantageously, provision will be made for the free edge 11 of the gutter 10 to occur at a lower level than the lower edge of the orifices 13. It will be noted that, due to the slope of the top wall 9, the space comprised between the wall 9 and the level of the water in the distributor when the water supply is arrested, is reduced to the maximum extent. Through this fact, the space which can be occupied by steam which enters the distributor is limited.

Naturally, a different number of plates could be utilized to form the distributor which, particularly in the shape of the duct, could then permit other modifications within the scope of the invention.

I claim:

1. Distributor for the admission of fluid to be vaporized in a steam generator formed by a duct and flow means for said fluid communicating the inside of said duct with the surrounding medium, said flow means being located in the uppermost part of said duct so as to obviate the entrapment of vapor pockets during filling of said duct or when the water level in said generator is at a lower level than a plane passing through said flow means, said duct (5) comprising (a) a curved wall (2) having a U-shaped profile and forming the base of said duct;

(b) a first side wall (6 A) the lower edge of which is connected to the inner edge of said curved wall (2);

(c) a second side wall (7) the lower edge of which is connected to the inner edge of said curved wall (2);

(d) an upper wall (9) the edges of which are respectively connected to the upper edge of said second side wall (7) and to the upper edge of said first side wall (6); said upper wall (9) being upwardly inclined from said second side wall (7) to said first side wall (6) and having a portion (10) projecting beyond said first side wall (6) and curved downwardly;

(e) at least one orifice (13) being provided adjacent the upper edge of said first side wall (6) to constitute said flow means.

2. Distributor according to claim 1, wherein the free end of the incurved extension is situated at a lower level than the orifices (13).

3. Distributor according to claim 2, comprising three metal plates welded to one another, the first one of said plates being bent into a U-shape to form the bottom (2), the second one of said plates being flat and forming the lateral wall (6) pierced by orifices (13), and the third one of said plates being folded into a V, one of the arms of the V forming the second lateral wall (7), while the other arm of the V forms the top wall (9).

* * * * *